United States Patent [19]

Ahlers

[11] 4,277,928

[45] Jul. 14, 1981

[54] CONTROL ARRANGEMENT, ESPECIALLY FOR APPARATUS FOR CLOSING CONTAINERS SUCH AS BOTTLES

[75] Inventor: Egon Ahlers, Bad Kreuznach, Fed. Rep. of Germany

[73] Assignee: Seitz-Werke GmbH, Bad Kreuznach, Fed. Rep. of Germany

[21] Appl. No.: 90,533

[22] Filed: Nov. 2, 1979

[30] Foreign Application Priority Data

Nov. 16, 1978 [DE] Fed. Rep. of Germany ..... 2849741

[51] Int. Cl.[3] ..... B65B 57/02

[52] U.S. Cl. ..... 53/67; 53/64

[58] Field of Search ..... 53/67, 68, 69, 70, 71, 53/72, 64

[56] References Cited

U.S. PATENT DOCUMENTS

| | | | |
|---|---|---|---|
| 2,866,306 | 12/1958 | Sennello | 53/70 |
| 2,934,869 | 5/1960 | Engleson et al. | 53/67 X |
| 3,121,984 | 2/1964 | Runco | 53/67 |

*Primary Examiner*—Robert D. Baldwin

*Attorney, Agent, or Firm*—Becker & Becker, Inc.

[57] ABSTRACT

A control arrangement for a control member for opening and closing of the exit of a feed channel communicating a closure magazine and a closure transfer device, especially for apparatus for closing containers such as bottles and the like to which a closure is to be secured. The control member is controllable by means of an opto-electric sensor arrangement which is actuatable by a proximity switch which, in turn, is actuatable by a control cam. The sensor is arranged at such a distance away from the point of tangency of the pitch circles respectively prescribed by the transport wheel and the rotating securing devices, laterally of the transport path of the transport wheel and its beam is directed transverse to the transport path to strike a container held by the transport wheel to project from the upper side or the lower side thereof, such that the control member is retained in its open position when a container is sensed and, when the absence of a container is sensed, i.e. when a pertaining pocket of the transport wheel is not occupied by a container and the beam is reflected, the control member assumes its closed position for the closure intended for an absent container.

4 Claims, 6 Drawing Figures

CONTROL ARRANGEMENT, ESPECIALLY FOR APPARATUS FOR CLOSING CONTAINERS SUCH AS BOTTLES

The present invention relates to a control arrangement, especially for apparatus for closing containers, such as bottles and the like, which apparatus is of the rotary type and has several closing means for securing crown caps or similar closures which are magnetically susceptible, to the containers.

Such apparatus includes a feeding channel for guiding the closures on the path from a storage magazine to a closure transfer device. The closure transfer device includes a transport wheel, a closure support, and a control member. The transport wheel has several arms and is generally arranged at the outlet of the feeding channel and in conformity with the circular path of the closing means, generally horizontal beneath the elements of the closing means for holding a closure. The plate-like closure support is arranged horizontally beneath the arms, or the wheel and includes a guide wall extending upwardly from the exit or outlet of the feeding channel near to the circular path of the pertaining closing elements.

An apparatus for closing has become known in which a controllable lock member is provided at the channel outlet. It is the purpose of the controllable lock member, in association with an actuating device arranged in the vicinity of the conveyor for delivering containers to the conveyor at the closing station, to open the channel outlet when the apparatus is operating and to close the channel outlet when the apparatus is at rest.

It is an object of the present invention to provide a control arrangement operable in such a way that the pertaining lock member of a rotating closing apparatus is opening the channel for feeding container closures when the conveyor introducing containers to the closing station is loaded, while the channel is closed in conformity with the sequence of containers delivered when absence of a container on the conveyor is sensed.

This object and other objects and advantages of the present invention will appear more clearly from the following specification in connection with the accompanying drawings, in which.

Figure 1:
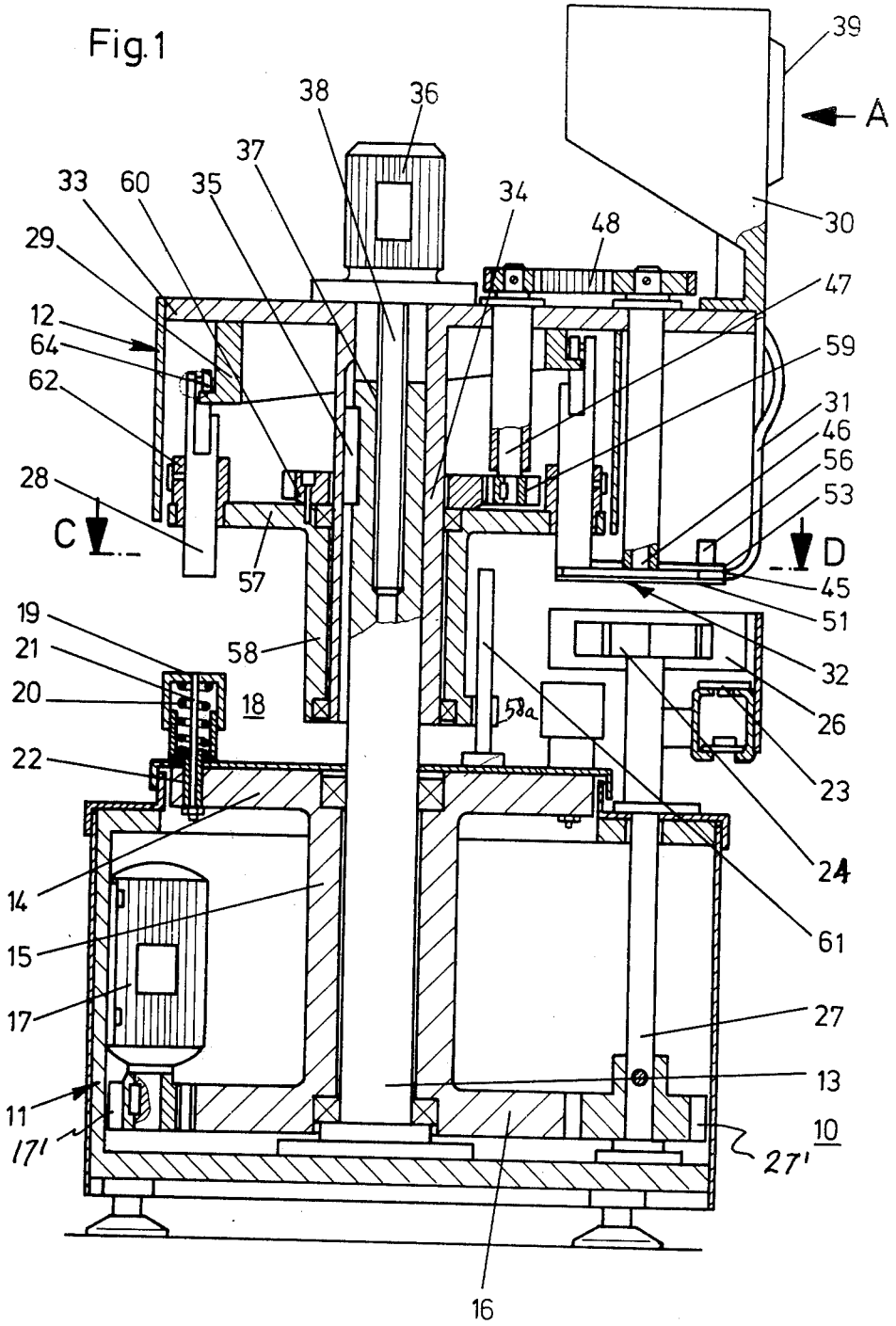
FIG. 1 is a side elevational view, partly in cross section, of a container closing apparatus with a control arrangement in accordance with one embodiment of the invention.

The present invention is characterized primarily therein that the lock or control member is controllable by an optoelectric sensing means which, in turn, is actuatable by a switch, and this switch is actuatable by a control cam. The sensing means is arranged with such a distance from the point of tangency of two base or pitch circles; whereby one base circle pertains to the conveyor which feeds containers to the closing means, and the other base circle pertains to the circular path of the closing means. The sensing means is arranged from the point of tangency laterally of the path of the feed conveyor, which is preferably a transport wheel having circumferential pockets, and the longitudinal central axis of the sensing means extends transverse to the path of the containers, which container project either above the transport wheel or below the transport wheel. The lock member is usually in its open position and remains in this position when a container is sensed, i.e. when the sensing beam is not incident on its receiving surface, or is interrupted. When no container is sensed, i.e. when the sensing beam is incident on or strikes the pertaining receiving surface, the lock member assumes the closing position which means that the sequence is interrupted and the sequence of closures is adjusted in conformity with this disruption.

The present invention provides that during rotation of the apparatus no closures are supplied to the closure transfer device or devices to obviate the need to remove these again. Thus, the present invention provides for a substantial saving of closures. Furthermore, disruptions caused due to removal of unused closures from the pertaining closing devices at the feeding area of the apparatus are avoided.

In accordance with a preferred embodiment of the invention, the distance of the sensing means away from the point of tangency of the two base or pitch circles is such that the longitudinal central axis of a sensing means forms one side of an angle $\alpha$, which is in conformity with a multiple of the angle $\beta$ between two pockets. The apex of the angle $\alpha$ coincides with the axis of rotation of the transport wheel, and the other side of the angle $\alpha$ extends from the apex through the point of tangency whereby the angle is measured from this latter side in the direction opposite to the direction of movement of the transport wheel.

In accordance with another embodiment of the invention, the control cam for actuating the switch of the sensing means is arranged on a shaft operatively connectible to the drive elements of the apparatus, whereby the control cam is rotated in conformity with movement of the transport wheel, or during movement of the containers by this transport wheel. The cam is adapted to actuate the switch so that a closure will not be released by the lock member in conformity with the pertaining sequence of containers on the transport wheel, i.e. in the absence of a container on the transport wheel.

In accordance with another preferred embodiment of the invention, the sensing means includes a reflection-lightgate with a light-emitter-receiver and an oppositely arranged receiving surface or reflector arranged in a plane, and outside of the circumference of the transport wheel, below the transport wheel and outside of its path, with a sensing beam or light beam generally directed horizontally towards a container body, whereby the light-emitter-receiver is positioned outside of the circumference of a circle of the transport wheel while the reflector or receiving surface is arranged within the circle when viewed in plan view.

In accordance with yet another embodiment of the invention, when two channels for feeding closures from the magazine are provided for each channel, there is provided a further lock member, with each lock member being controllable by an associated sensing means.

These sensing means are actuatable by associated switches with pertaining control cams, whereby the second sensing means extends to the first sensing means at an angle in conformity with the angle of division $\beta$ between two immediately adjacent pockets of the transport wheel.

Referring now particularly to the drawings, the closing apparatus in accordance with one embodiment is generally designated by the numeral 10. The apparatus 10 comprises a lower section 11 and an upper section 12. Upper section 12 is journalled at the upper end of a fixed column or shaft 13. The shaft 13 extends in the lower section 11 of the apparatus 10.

Shaft 13 also extends through a rotating table or platform 14, which provides the upper limits of the lower section 11. This table 14 comprises a hollow shaft or hub 15 which carries the table or platform 14 at the upper end, while the lower end carries a gear wheel 16. A drive 17 is adapted to rotate the table 14 by means of an associated gear 17' operatively engaging the teeth of the gear 16.

Elements 18 for supporting containers to be closed are arranged on the upper surface of the table 14. These elements 18 are evenly distributed about the circumference of table 14 on a base circle extending through the centers of the elements 18.

Each element 18 is comprised of a cup-like bushing having an upper surface or disc portion 19, on which the container to be closed is placed, and a guide rod 21. The cup-like bushing is adapted to accommodate containers of various height by being resiliently biased by a spring 20. Spring 20, furthermore, is adapted to balance the closing force of closing devices. The cup-like bushing is guided by a sleeve 20' which is fixed on the table 14. A guide rod arrangement 22 is secured to the sleeve 20'.

In the normal position, all elements 18 present the support surface or disc portion 19 at the same level as the transport surface of a conveyor 23 associated with apparatus 10. Between conveyor 23 and table 14, there is arranged a delivery conveyor 24 or transfer or transport wheel, provided with circumferential pockets. Closed containers are removed from the table 14 by a further conveyor 25, also in the form of a transfer or transport wheel, which delivers closed containers onto conveyor 23*a*. The conveyor 24 is rotated by a shaft 27 which carries at its lower end a gear 27' which meshes with the gear 16, this gear—as has been mentioned—being driven by drive 17. The conveyor 25, in turn, is driven in a similar fashion by the intervention of a shaft 27*a*. Guides 26 and 26*a* are provided, respectively, for conveyors 23, 24 and 23*a*, 25.

The upper section 12 of apparatus 10 is generally comprised of the closing devices 28, the pertaining cam 29 for these devices, a magazine 30 for storing closures, and a channel 31 for feeding closures from magazine 30 to a closure transfer device 32. These components are generally arranged on a plate 33 extending horizontally. This plate 33 includes a hub 34 by which it is connected to shaft 13, with a key and groove 35 being provided to prevent rotation of plate 33 or, in other words, to ensure that plate 33 rotates when shaft 13 rotates.

On the upper side of plate 33 there is arranged the magazine 30 which, in this embodiment, is provided with two sorting wheels 39.

Figure 2:
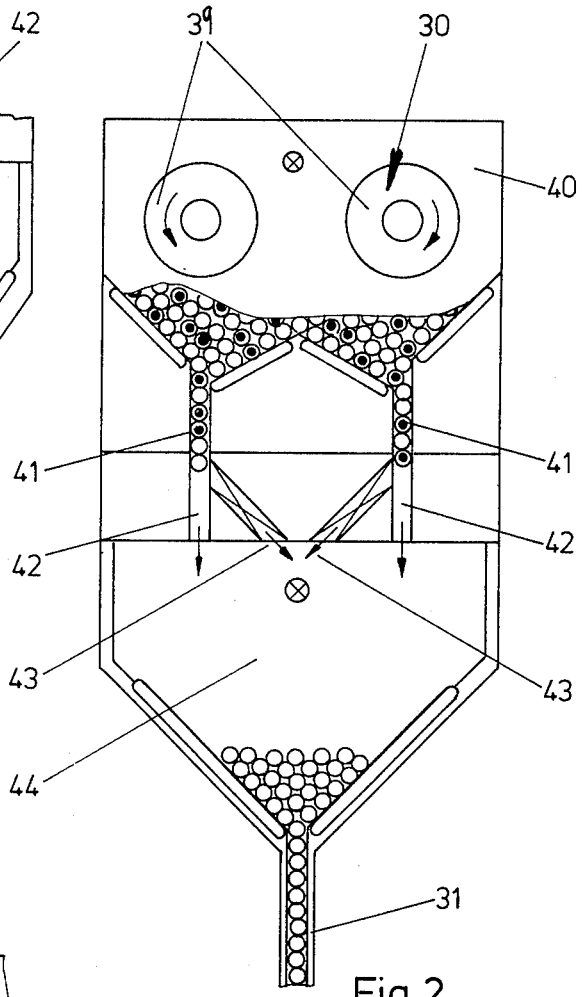
FIG. 2 is a side elevational view, in the direction of arrow A in FIG. 1, showing a magazine for storing closures and part of the channel for feeding closures to the closing station.

According to the embodiment shown in FIG. 2, magazine 30 has two sorting wheels 39 in the upper magazine space 40. With each wheel 39 there is associated, to lead out of the upper space 40, a reversal channel 41 which communicates with the outlet ends 42 and 43, respectively, in a lower collecting space 44 so that the closures are properly presented into the channel 31 at the lower end of collecting space 44. Channel 31 extends generally vertically. The outlet 45 (FIG. 1) of channel 31 is positioned horizontally opposite at the end of an arcuate channel portion of the closure transfer device 32.

Plate 33 also supports the drive means 36 for adjusting the vertical height of the upper section 12 by means of spindles 38 cooperating with threading 37 in a pertaining longitudinal bore in shaft 13.

The plate 33 furthermore serves to journal two vertical shafts 46 and 47, respectively, which are drivingly connected by a gear belt, or the like designated by numeral 48. At the lower end of shaft 46 there is provided a horizontal disc 49 which is also part of the transfer device 32. This horizontal disc 49 is provided with several arms 50 (FIG. 3) which are arranged about the circumference of disc 49 in conformity with the spacing of the closing devices 28.

At a distance below the arms 50, and in the same plane with the channel outlet 45, the closure transfer device 32 is provided furthermore with a horizontal, preferably circular, closure support 51. Support 51 includes a peripheral guide rim 52 extending from the lateral channel limit about the circular path of the arms 50 to the closure transfer to the closing devices 28.

The closure support 51 and the arms 50 of disc 49 are covered from above by means of a circular plate 53 arranged a small distance from rim 52. The closure support 51, the guide rim 52, and plate 53 are preferably formed of a material which is not susceptible to magnetic forces and form a closure guide, this closure guide also being part of the closure transfer device 32. In the closure guide comprised of parts 51, 52, and 53, for adaptation to the height of the particular closures at hand, the closure support 51 is releasable and adjustable as to vertical height, while the rim 52 is radially adjustable for adaptation to the particular configuration and the diameter of a closure. At the underside of the upper plate 53 there is arranged an abutment, not shown, which is opposite to the channel outlet 45 which is brought close to the plates 51 and 53. On the upper side of the plate 53 a magnet 56 is arranged. The magnet 56 is preferably a permanent magnet and the magnet field thereof is directed downwardly relative to the circumferential path of the arms 50. The magnetic field is effective in the area of the channel outlet 45 and the arms 50 passing in front thereof.

Numeral 57 (FIG. 1) designates a circular table on which are supported below plate 33, the closing devices 28. This table 57 is also provided with a hub 58 which surrounds the hub 34 of plate 33 and about which it can rotate. The table 57 carries on its upper side a fixedly secured gear 60 which meshes with a gear 59 of shaft 47. With arm 58' the table 57 is operatively connected to a rod 61 which, in turn, is secured to table 14. About the circumference of table 57 there are arranged vertical fixedly arranged guides 62 which are in line with the disc portions or surfaces 19 of the support 18. Guides 62 serve to guide reciprocating closing elements or devices 28. Each closing device 28 is provided at its upper end with a roll 64 running on the upper and underside of the cam 29. Two facing rolls 64 are indicated in FIG. 1.

Figure 4:
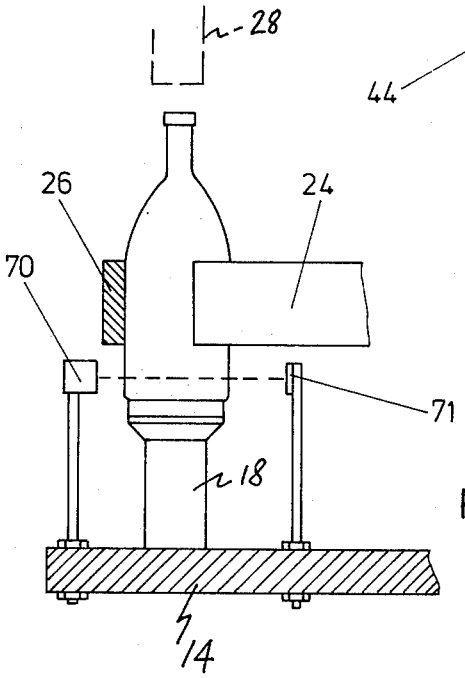
FIG. 4 is a side elevational view, partly in cross section, showing the arrangement of an opto-electric sensing means in relation to the feed conveyor.
Figure 3:
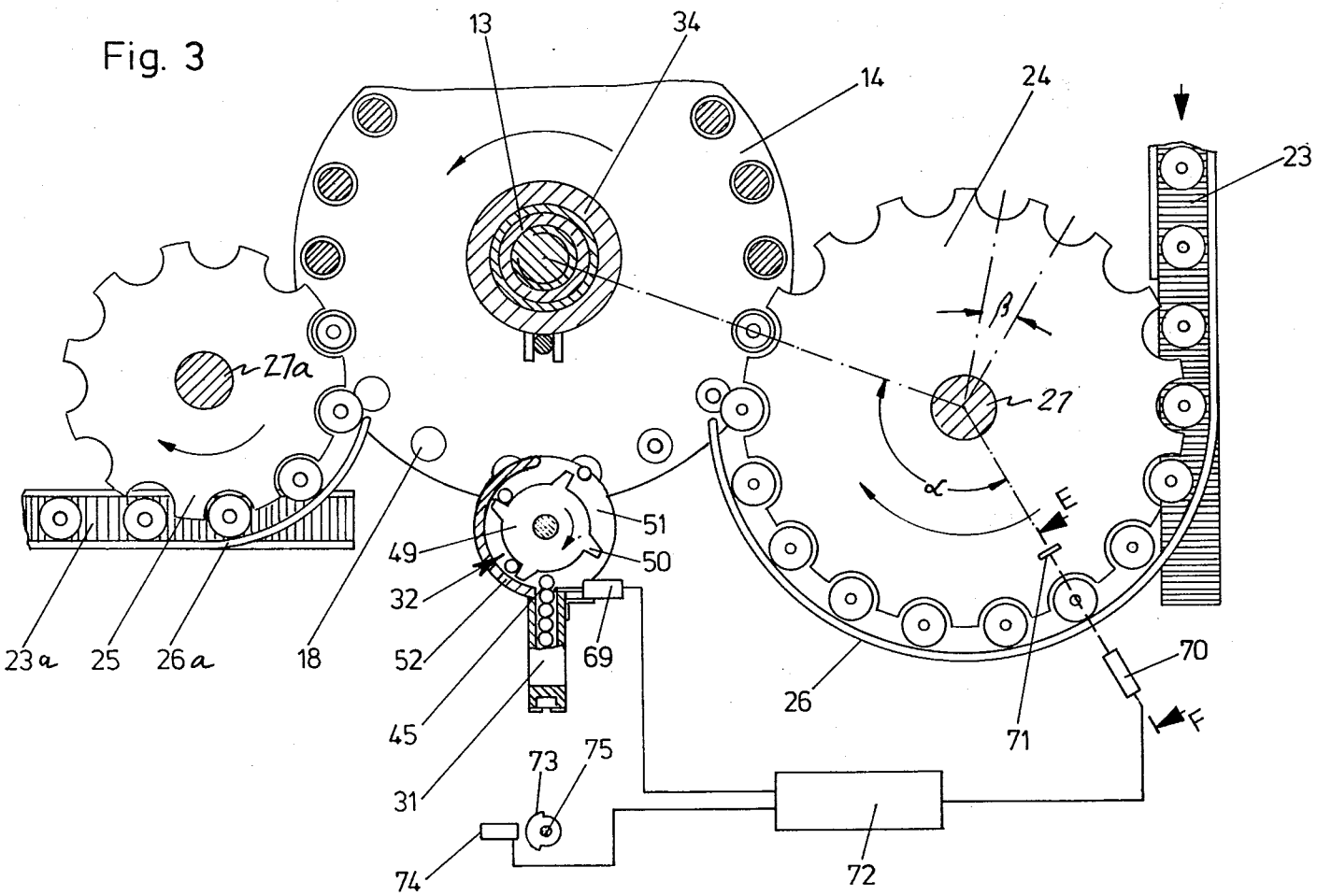
FIG. 3 is a top plan view, partly in section, along line C-D in FIG. 1.
Figure 6:
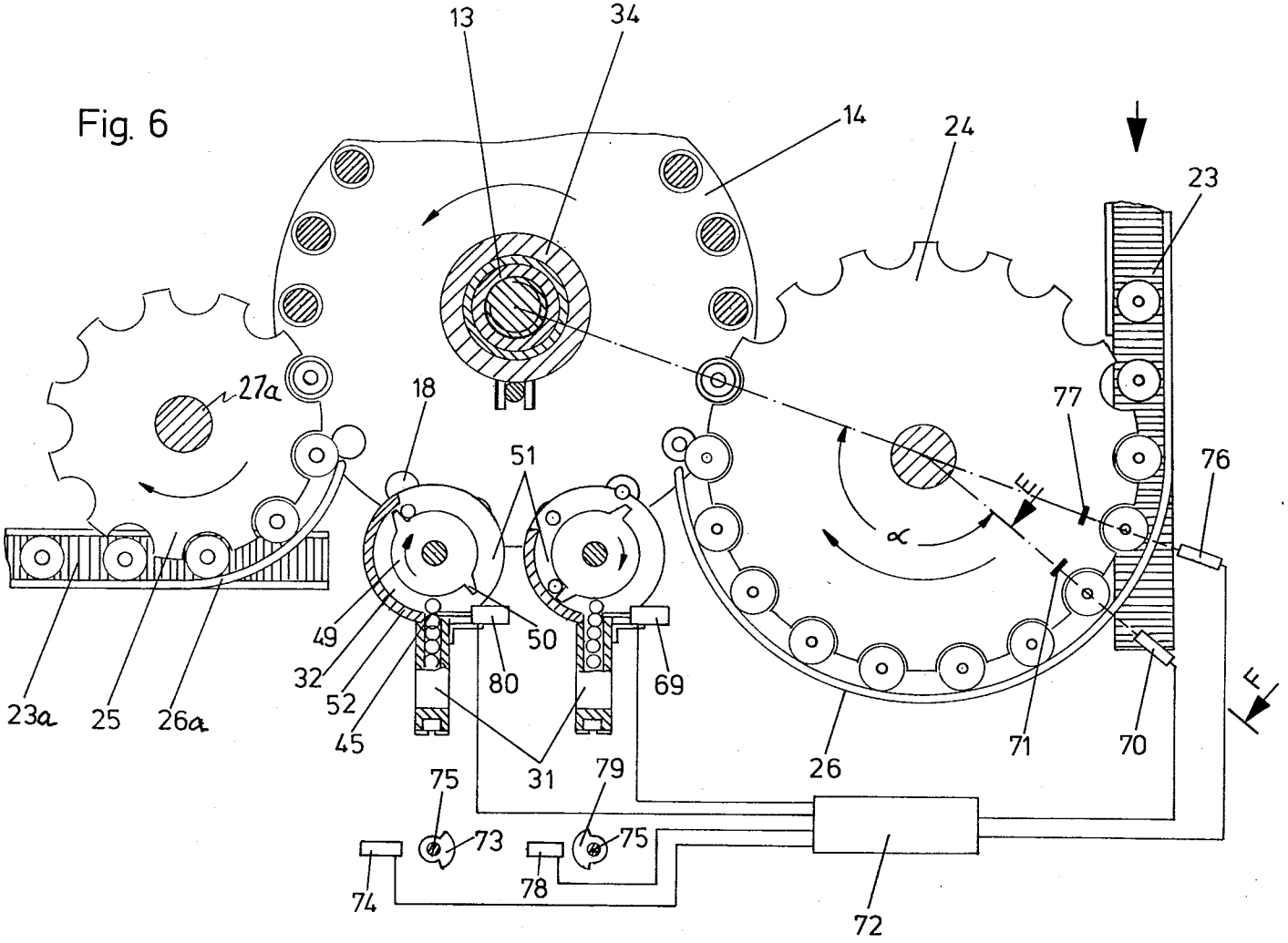
FIG. 6 is a plan view similar to FIG. 3 of yet another embodiment of the present invention with two channels for feeding closures.

Numeral 69 designates a controllable lock or control member arranged at the channel outlet 45 (FIGS. 3 and 6). The control arrangement for this lock or control member 69 comprises an opto-electric sensing means or sensor of the type of a reflection-light barrier, or gate, having a light-emitter-receiver 70 and a reflector or receiving surface 71. The light-emitter-receiver 70 is arranged to be outside of the path of the transfer wheel 24 below the plane of the wheel 24 so that its beam passes across the plane of rotation of the containers transported or conveyed by the transport wheel 24 (FIG. 4).

The receiver 70 is rendered operational, or switched on, by a proximity switch 74 which, in turn, is actuatable by a control cam 73. The control cam 73 is arranged preferably on a shaft 75 which, together with cam 73, completes a full revolution, when the transfer wheel rotates through a distance corresponding to the angle $\beta$, i.e. the angle between two immediately adjacent pockets of transport wheel 24.

The lock member 69, preferably in the form of a reciprocatingly movable pin, is operatively connected to the control means 72, whereby the pin extends with its free end at the channel outlet 45 and into the path of the closures. The other end of the pin is actuated by a control magnet, not shown, with the pin serving as the magnet armature.

The light gate 70, 71 is arranged at an angle $\alpha$ away from the point of tangency of the base circle of the transport wheel 24 and the base circle of the closing devices 28, measured in the direction opposite to the direction of the arrow indicating the direction of transfer wheel 24. This angle $\alpha$ is obtained by multiplying the number of closures present, at uninterrupted sequence of containers, from the point of tangency in the direction opposite to the direction of the apparatus, on the closing devices 28 and in the closure transfer device 32, by the angle $\beta$.

The apparatus described in the foregoing operates as will be described next.

Prior to operation of apparatus 10 the sorting wheels 39 are actuated in order to have closures which at the channel outlet 45 are presented with their inner side directly upwardly in the collecting space 44 of magazine 30 and in channel 31.

Closures present in the magazine space 40 move through the reversal channels 41 to be aligned as required and drop, after having assumed the proper position or attitude, through the channel outlets 42 into the collecting space 44. Any closures which are not properly positioned or aligned are reversed in the channels 41 to be brought into their proper position and are then passing through the channel outlets 43 into the collecting space 44. The properly arranged closures pass, due to gravity, through the channel 31, the outlet 45 of which is at this point closed by the lock member 69, so that the first closure in contact with the lock member 69 and subsequent closures stack with the rim one above the other. As the sorting wheels 39 continue to rotate and when the apparatus 10 is operated, filled containers are moved by the conveyor 23 into the transport wheel 24. The sensing means 70, 71, actuated by the also rotating cam 73, actuates switch 74 so that the sensing means is operative whereby the lock member 69 is moved for opening the channel outlet 45 so that magnet 56 attracts the first available closure. The magnetic force removes this closure from the outlet 45 and lifts it, whereby the closure slides with its upper side along on the underside of the upper plate 53 until it reaches the abutment 54 (FIG. 1) where it adheres to the plate 53 due to the magnetic force. In this position, the closure is fixed on the circular path of the arms 50 which are rotated upon actuation of the apparatus 10 by means of the gear elements 60, gear 58, shaft 47, gear transmission 48, and shaft 46 and take over a fixedly held closure which is guided along the closure guide 51, 52, 53 and transferred at the point of tangency of the respective circles prescribed by the arms 50 and the closing device to the holding device, not shown, of a closing device 28 respectively moving above the arms 50 in a circular path.

The further rotating control cam 73, while the apparatus 10 is in operation, which carries out a full revolution when the transfer wheel carries out a movement corresponding to the angle $\beta$, actuates the proximity switch 74, respectively, while approaching for actuating the light barrier 70, 71. When sensing a container in the pertaining pocket, whereby the beam emanating from sensor 70 and directed towards receiver 71, this beam extending substantially horizontally, is disrupted by the container body so that the lock member 69 is retained in its open position. On the other hand, when the beam is reflected by the reflector 71, which means that no container is present in the pertaining pocket of the transport wheel 24, the resulting signal causes closure of the lock member 69 so that no closure is released to the closure transfer device 32, in conformity with this empty pocket of the transfer wheel 24. The next container that is sensed then causes release of a pertaining closure since the lock member 69 is moved to assume its open position.

Figure 5:
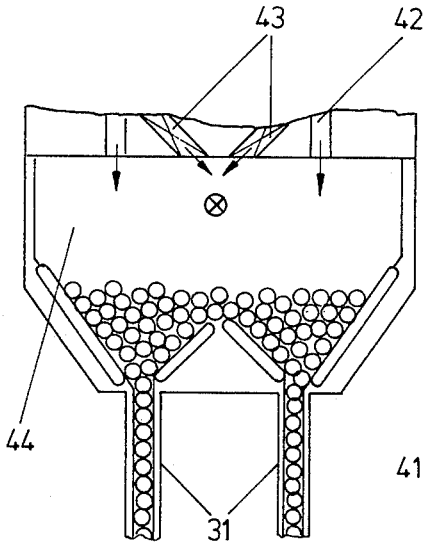
FIG. 5 is a view similar to FIG. 2 showing a magazine with two channels for feeding closures.

When closures are transferred from magazine 32 to the closing devices 28 through two channels 31 and two closure transfer devices 32 (FIG. 5), whereby each closure transfer device 32 supplied respectively a next succeeding closing device 28, and for this purpose at the disc 49 there are provided only two arms 50, then each lock member 69,80 associated with the outlet of the two channels 31 is provided with a sensing means 70, 71 and 76, 77, respectively, and each one is associated with a proximity switch 74 and 78, respectively, while further there is provided for each a control cam 73 and 78 (FIG. 6). Both control cams 73 and 78 are arranged on the drive shaft 75 and offset to one another. The arrangement of the two sensing means 70, 71 and 76, 77, respectively, is laterally of the container transport path of the transport wheel 24 in such a way that the sensing means 70, 71, controlling the lock members 69 of the channel 31 adjacent to the transfer wheel 24, is away from the point of tangency of the base or pitch circles of the transfer wheel 24 and the closing devices 28 at an angle $\alpha$. This angle $\alpha$ is obtained by multiplying the number, at uninterrupted container sequence, viewed from the point of tangency in the direction opposite the direction of operation of the apparatus, of closures transferred from the closure transfer device 32 associated with channel 31 to the closing devices 28 and closures still present in the associated closure transfer device 32, by two times the angle between two adjacent pockets of the transport wheel 24. Ahead of this sensing device 70, 71 there is arranged the sensing means for controlling the lock member 80 adjacent channel 31. The sensing means 76, 77 is arranged away from sensing means 70, 71 by a distance corresponding to angle $\beta$ or a multiple of angle $\beta$, i.e. the angle of division of two adjacent pockets of transport wheel 24.

The light-emitter-receivers and reflectors of both sensing means and the beam paths are arranged in the aforementioned sense.

Again when the apparatus is operating, the rotating control cams 73 and 79 actuate, during half a rotation, the pertaining proximity switch 74 and 78, respectively, for actuating the light gates 70, 71 and 76, 77 which then, when the pertaining pocket is occupied and the beam is interrupted or when the pocket is not occupied and the beam is reflected, control the open lock member 69 or 70 in the aforementioned sense. An actuation of the respective light gate 70, 71 and 76, 77 by the associated proximity switch 74 and 78 occurs then when the absence of a container is sensed.

In the case of the control arrangement for a single channel and for a double channel the actuation of the beam, for avoiding control errors, is carried out only then when the container, moved in a pocket, is to such an extent in the effective reach of the sensing means so that the ray or beam cannot be reflected until the container leaves the range or effective region of the beam. On the other hand, emission of a beam is terminated prior to a container leaving the range or effective region of the beam. Accordingly, the duration of the beam is in conformity with the rotation of the control cams which are effecting the actuation of the proximity switch or switches.

The present invention is, of course, in no way restricted to the specific disclosure of the specification and drawings, but also encompasses any modifications within the scope of the appended claims.

What I claim is:

1. A control arrangement, especially for apparatus for closing containers such as bottles and the like to which a closure is to be secured, which apparatus includes a magazine for storing a plurality of closures, at least one closure transfer device, at least one channel for communicating a pertaining closure transfer device and said magazine, at least one means for securing a closure to a container, and conveyor means adapted to deliver containers to said at least one securing means, said arrangement comprising:

for each closure transfer device, a control member operatively arranged near the pertaining closure transfer device; and for each control member an opto-electric sensing means operatively arranged in the vicinity of said conveyor means, adapted to sense the absence of a container on said conveyor means, and thereupon adapted to actuate a pertaining control member in such a way that said control member prevents release of a closure to a pertaining transfer device, with said conveyor means and said at least one securing means prescribing respective pitch circles tangent to one another and with each opto-electric sensing means being positioned at a predetermined distance away from said point of tangency, said conveyor means including a transport wheel having a plurality of circumferential pockets, with a container being adapted to be transported by said transport wheel in such a way that it is nestled in a pocket thereof, each opto-electric sensing means being adapted to emit a sensing beam adapted to intersect an exposed portion of a container conveyed by said transport wheel, a single closure transfer device, wherein the longitudinal central axis of a beam emitted by the pertaining opto-electric sensing means forms one side of an angle $\alpha$ the apex of which coincides with the axis of rotation of said transport wheel and the other side of said angle extends from said apex through said point of tangency, said angle $\alpha$ corresponding to a multiple of the angle of division $\beta$ defined by an apex which coincides with the axis of rotation of said transport wheel and sides which extend through the centers of two immediately adjacent pockets of said transport wheel, and, when viewed starting from said point of tangency in the direction opposite to the direction of movement of said securing means, the angle $\alpha$ being defined by the product of said angle $\beta$ multiplied by the number of closures present in the pertaining closure transfer device and on each securing means, at uninterrupted container sequence, said opto-electric sensing means including a switch to render the opto-electric sensing means operational, means for actuating said switch, said switch actuating means including a shaft and a control cam operatively connectible to said shaft, with said cam being adapted to make one full revolution in conformity with movement of said transport wheel over a distance corresponding to said angle of division $\beta$, and being adapted to actuate said switch in the absence of a container in a pertaining pocket which is being monitored by said sensing means.

2. A control arrangement according to claim 1, wherein said sensing means comprises a reflection-light-gate including a light-emitter-receiver and a reflecting surface being arranged to be disposed in a substantially common plane to one another below said transport wheel and beyond the path of said transport wheel, said light-emitter-receiver being arranged at the outside and said reflecting surface being arranged at the inside of the pitch circle of said transport wheel, when viewed in plan, with a beam emitted by said light-emitter-receiver extending substantially horizontal in the direction toward a pocket so as to be adapted to strike a container nestled in a pocket.

3. A control arrangement, especially for apparatus for closing containers such as bottles and the like to which a closure is to be secured, which apparatus includes a magazine for storing a plurality of closures, at least one closure transfer device, at least one channel for communicating a pertaining closure transfer device and said magazine, at least one means for securing a closure to a container, and conveyor means adapted to deliver containers to said at least one securing means, said arrangement comprising:

for each closure transfer device, a control member operatively arranged near the pertaining closure transfer device; and for each control member an opto-electric sensing means operatively arranged in the vicinity of said conveyor means, adapted to sense the absence of a container on said conveyor means, and thereupon adapted to actuate a pertaining control member in such a way that said control member prevents release of a closure to a pertaining transfer device, with said conveyor means and said at least one securing means prescribing respective pitch circles tangent to one another and with each opto-electric sensing means being positioned at a predetermined distance away from said point of tangency, said conveyor means including a transport wheel having a plurality of circumferential pockets, with a container being adapted to be transported by said transport wheel in such a way that it is nestled in a pocket thereof, each opto-electric sensing means being adapted to emit a sensing beam adapted to intersect an exposed portion of a container conveyed by said transport wheel, a first closure transfer device, and a second closure transfer device, wherein the longitudinal central axis of a beam emitted by the pertaining opto-electric sensing means associated with said first closure transfer device forms one side of an angle $\alpha$ the apex of which coincides with the axis of rotation of said transport wheel and the other side of said angle $\alpha$ extends from said apex through said point of tangency, said angle $\alpha$ being defined by the product of twice the angle of division $\beta$, defined by an apex which coincides with the axis of rotation of said transport wheel and sides which extend through the centers of two immediately adjacent pockets of said transport wheel, and the sum of the number of closures transferred from said first closure transfer device to said at least one securing means plus closures available in said first transfer device, at uninterrupted container sequence and when viewed starting from said point of tangency in the direction opposite to the direction of movement of said at least one securing means, with the longitudinal central axis of the pertaining opto-electric sensing means associated with said second closure transfer device forming one side of an angle the apex of which is at the axis of rotation of said transfer wheel, one side of which coincides with the longitudinal central axis of the opto-electric sensing means associated with said first closure transfer device, and which is measured in the direction opposite the direction of movement of said transport wheel, said angle corresponding to said angle $\beta$ and multiples thereof.

4. A control arrangement according to claim 3, and further comprising a shaft, wherein each opto-electric sensing means includes a switch and a cam, each cam being operatively connectible to said shaft, with each cam being adapted to make half a revolution in conformity with movement of said transport wheel over a distance corresponding to said angle $\beta$, and each cam being adapted to actuate its pertaining switch when absence of a container is sensed by a pertaining opto-electric sensing means.

* * * * *